US007287833B2

(12) United States Patent
Howard

(10) Patent No.: US 7,287,833 B2
(45) Date of Patent: Oct. 30, 2007

(54) FLUID EJECTION DEVICES AND OPERATION THEREOF

(75) Inventor: Peter Guy Howard, Junction City, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 270 days.

(21) Appl. No.: 10/822,956

(22) Filed: Apr. 13, 2004

(65) Prior Publication Data

US 2005/0225598 A1 Oct. 13, 2005

(51) Int. Cl.
*B41J 2/14* (2006.01)

(52) U.S. Cl. ..... 347/51

(58) Field of Classification Search ..... 347/42, 347/51, 54, 56, 61, 52, 20
See application file for complete search history.

(56) References Cited

U.S. PATENT DOCUMENTS 4,312,009 A * 1/1982 Lange ..... 347/51
5,021,808 A 6/1991 Kohyama
5,521,140 A * 5/1996 Matsuda et al. ..... 503/227
5,594,480 A * 1/1997 Sato et al. ..... 347/51
6,056,388 A 5/2000 Maximovsky et al.
6,068,363 A * 5/2000 Saito ..... 347/17
6,177,151 B1 1/2001 Chrisey et al.
6,270,194 B1 8/2001 Maximovsky et al.
6,474,783 B1 11/2002 Pilossof et al.
2003/0017277 A1 1/2003 Young et al.

OTHER PUBLICATIONS

David West, Gerhard Beenen, Brian Boso, Edward Hershberg, Philip Krein, "Feasibility of a Laser-Driven Thermal Ink Jet," 1986, SID 86 Digest, pp. 7-10.
S. Matts Goho, T. E. Orlowski, "Microscopic Bubble Formation and Collapse at Liquid Solid Interfaces During Electrical Powering of Thin Film Structures," 1988, Thin Solid Films, pp. 335-344.

* cited by examiner

*Primary Examiner*—Stephen Meier
*Assistant Examiner*—Geoffrey S. Mruk

(57) ABSTRACT

Briefly described, embodiments of this disclosure include systems and methods for ejecting fluid from a fluid ejection system. One exemplary method, among others, includes: heating a fluid to a lower threshold using an electric heating layer; heating the fluid to an upper threshold using laser energy; and ejecting a volume of fluid.

16 Claims, 3 Drawing Sheets

FLUID EJECTION DEVICES AND OPERATION THEREOF

BACKGROUND

An inkjet printing system, as one embodiment of a fluid ejection system, may include a printhead assembly, an ink supply which supplies liquid ink to the printhead assembly, and an electronic controller which controls the printhead assembly. The printhead assembly, as one embodiment of a fluid ejection assembly, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead assembly and the print medium are moved relative to each other.

Typically, the printhead assembly ejects the ink drops through the nozzles by rapidly heating a small volume of ink located in vaporization chambers with small electric heaters, such as thin film resistors, often referred to as firing resistors. Heating the ink causes the ink to vaporize and be ejected from the nozzles. Typically, for one dot of ink, a remote printhead assembly controller typically located as part of the processing electronics of a printer, controls activation of an electrical current from a power supply external to the printhead assembly. The electrical current is passed through a selected firing resistor to heat the ink in a corresponding selected vaporization chamber.

One method of controlling the application of the electrical current through the selected firing resistor is to couple a switching device, such as a field effect transistor (FET), to each firing resistor. In one printhead arrangement, the firing resistors are grouped together in primitives, with a single power lead providing power to the source or drain of each FET for each firing resistor in a primitive. Each FET in a primitive has a separately energizable address lead coupled to its gate, with each address lead coupled to its gate, with each address lead shared by multiple primitives. In a typical printing operation, the address leads are controlled so that only a single firing resistor in a primitive is activated at a given time.

In one arrangement, the address lead coupled to the gate of each FET is controlled by a combination of nozzle data, nozzle addresses, and a fire pulse. The nozzle data is typically provided by the electronic controller of the printer and represents the actual data to be printed. The fire pulse controls the timing of the activation of the electrical current through the selected firing resistor. Typical conventional inkjet printing systems employ the electronic controller to control the timing related to the fire pulse. The nozzle address is cycled through all nozzle addresses to control the nozzle firing order so that all nozzles can be fired, but only a single nozzle in a primitive is fired at a given time.

While such arrangements are effective in controlling nozzle firing, connections between remote elements and the printhead assembly and between elements on the printhead assembly itself can become complex, especially as the number of nozzles on the print head area increase. An example of such a complex system is referred to as a wide-array inkjet printing system. A page-wide array printhead spans the width of an entire page of media (e.g., 8.5 inches for paper utilized in the United States) and is fixed relative to the media path. A page-wide array printhead assembly includes a page-wide array printhead with thousands of nozzles that span the entire page width. The page-wide array printhead assembly is typically oriented orthogonal to the paper path. During operation, the page-wide array printhead assembly is fixed, while the media is moved under the assembly. The page-wide array printhead assembly prints one or more lines at a time as the page moves relative to the assembly.

A problem with page-wide array printing includes maintaining accurate drop weights while at the same time increasing operating speeds of a page wide array printhead. Another problem with page-wide array printing includes the large amounts of energy required to cause ink drop ejection.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

FIG. 2A illustrates an embodiment of a page-wide array printhead assembly, while

DETAILED DESCRIPTION

Fluid ejection systems and methods of use thereof are provided. In particular, the embodiments relate to laser driven thermal fluid ejection systems. In one embodiment, the fluid ejection system uses a two-part heating process to emit or eject fluid (e.g., pigment-based inkjet inks and/or dye-based inkjet inks) from a page-wide array printhead assembly. In particular, energy from a first heating source (e.g., a resistor) in a page-wide array printhead assembly initially heats the fluid to a first threshold. In addition, energy from a second heating source (e.g., a laser system) heats the fluid from the first threshold to a second threshold, which causes a volume of fluid (e.g., a drop) to be ejected from the page-wide array printhead assembly onto a media (e.g., paper or transparency).

Figure 1:
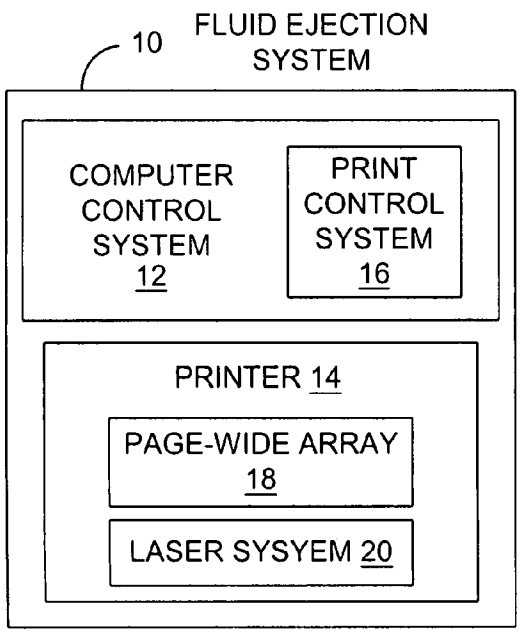
FIG. 1 illustrates an embodiment of a fluid ejection system.

FIG. 1 illustrates a block diagram of a representative fluid ejection system 10 (i.e., page-wide array printer system 10) that includes a computer control system 12 and a printer 14, which is one embodiment of a fluid ejection system 10. The computer control system 12 includes a print control system 16. The printer 14 includes a page-wide array 18 and a laser system 20, which is one embodiment of a fluid ejection system 10. The print control system 16 is operative to control the printing process of the printer 14.

Figure 2A:
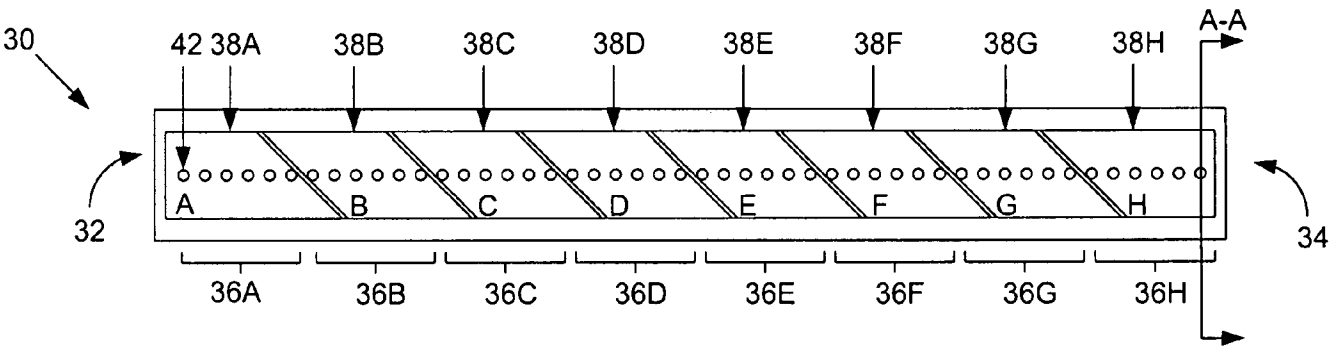
Figure 2B:
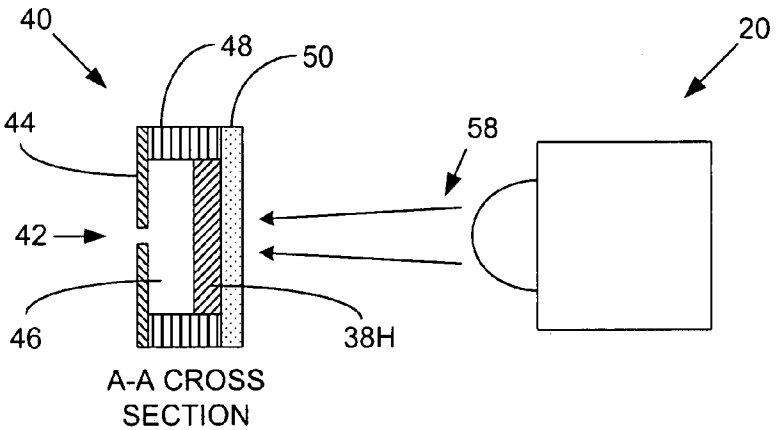
FIG. 2B illustrates a cross-section of a representative nozzle system (cross section A-A of FIG. 2A)

The page-wide array 18 includes, but is not limited to, a page-wide array printhead assembly 30, which is illustrated in FIG. 2A. The page-wide array printhead assembly 30 includes a first end 32 and a second end 34. In addition, the page-wide array printhead assembly 30 includes a plurality of areas 36A . . . 36H located from the first end 32 to the second end 34 of the page-wide array printhead assembly 30. Each area 36A . . . 36H includes a portion of a heating layer 38A . . . 38H and a plurality of nozzles systems 40 (FIG. 2B). A subset of the plurality of nozzles are disposed within each heating layer 38A . . . 38H. Although the page-wide array printhead assembly 30 is depicted as being divided into eight areas in FIG. 2A, page-wide array printhead assemblies 30 can be divided into any number of desired areas (e.g., 48 to 100 areas). In addition, although each area 36A . . . 36H is depicted as including six nozzle systems 40, each area can include any number of desired nozzles (e.g., from about 50 to 100 nozzle systems 40). In one embodiment, the page-wide array 18 includes about 2000 to 8000 nozzle systems. In other embodiments, the number of nozzle systems may vary depending on the requirements of the system (e.g., resolution and/or speed).

Heating layers 38A . . . 38H include, but are not limited to, one or more electronic heating layer(s) and a plurality of photon absorbing layers. In one embodiment, the one or more electronic heating layers include a resistive layer and a conductive layer (e.g., a heating resistor). In addition, electronic heating layers may be coupled contacts located on the page-wide array 18 via conductive paths or electrodes as are well known in the art. The contacts can then be coupled to the printer 14 to provide energy to the electronic heating layers. In one embodiment, the resistive layer and conductive layer can be formed using materials such as tantalum and aluminum. In one embodiment, the photon absorbing layer includes materials such as tantalum nitride.

In certain embodiments, the one or more electronic heating layers are separated from the photon absorbing layer via electrically insulating layers. In other embodiments, electrically insulating layers are not utilized. In further embodiments, one or more of the photon absorbing layers and electronic heating layers are substantially coplanar but located at different positions in a single layer. In additional embodiments, electronic heating layers are located proximate to fluid (ink) chamber 46, while photon absorbing layers are located proximate transparent substrate 50. (FIG. 2B)

In one embodiment, the heating layer 38A . . . 38H is a single layer, where the electronic heating layer and the photon absorbing layer are formed of the same material. In another embodiment, the heating layer 38A . . . 38H includes at least two layers, where at least one layer is the electronic heating layer and at least one layer is the photon absorbing layer.

Each nozzle system 40 includes, but is not limited to, an orifice 42, an orifice layer 44, a fluid (ink) chamber 46, a barrier layer 48, a transparent substrate 50, and the heating layer 38A . . . 38H. A portion of one of the heating layers 38A . . . 38H is positioned adjacent the ink chamber 36. In particular, a portion of the electric heating layer is disposed in each nozzle system 40, while each nozzle system 40 has a photon absorbing layer that can be activated independently of the photon absorbing layers for other nozzle systems 40.

The ink chamber 46 is capable of holding a volume of fluid (for example, ink) (not shown) such as, but not limited to, pigment-based inkjet inks and/or dye-based inkjet inks. These can include black ink and inks having a plurality of colors such as, but not limited to, cyan, yellow, and magenta. The barrier layer 48 functions to separate the ink flow so that ink can be individually provided to each nozzle system 40. In one embodiment, barrier layer 48 can be made of materials such as, but not limited to, Kapton™, Upilex™, (3M Corp), or like material. The transparent substrate 50 is transparent to the laser energy 58 emitted by the laser system 20. In one embodiment, the transparent substrate 50 can be made of material such as, but not limited to, glass, quartz or like material.

When the heating layers 38A . . . 38H are activated (e.g., turned on electronically and/or through absorption of laser energy), the heating layers 38A . . . 38H input energy (i.e., heat) to cause the ink to increase in temperature. In particular, the electronic heating layer is capable, upon electrical activation, of heating the ink in the ink chamber 46 for a specific area 36A . . . 36H. The photon absorbing layer is capable, upon activation by laser energy, of heating the ink in the ink chamber 46 for a specific nozzle system 40 located in a specific area 36A . . . 36H.

The electronic heating layers of the heating layers 38A . . . 38H are positioned so that each electronic heating layer overlaps a portion of the adjacent area. For example, the electronic heating layer in heating layer 38A overlaps a portion of area 36B. Thus, activating the electronic heating layer of heating layer 38A causes the ink in area 36A to be heated, while also heating the ink in the overlapped portion of area 36B. In particular, the ink in the nozzle systems 40 in the portion of the overlapped area 36B is heated. Heating the ink in this manner allows portions of the ink to be heated instead of heating the entire volume of ink. Also, the overlapping scheme of the electronic heating layers assists in generating a continuous thermal wave to proceed from area to area (i.e., from area 36A to 36B and so on).

The electronic heating layer in the heating layer 38 in each area 36A . . . 36H can be activated by the print control system 16 in accordance with print information corresponding to the information to be printed onto the media. The electronic heating layers of the heating layers 38A . . . 38H may be heated in a sequential or non-sequential manner, depending on the nozzle systems that are to eject ink on the media at the give time, from the first end 32 to the second end 34 of the page-wide array printhead assembly 30. In particular, the print control system 16 activates the electronic heating layer in heating layer 38A, then activates the electronic heating layer in heating layer 38B, and so on, in a sequential manner across the page-wide array printhead assembly 30. As subsequent electronic heating layers in heating layers 38A . . . 38H are activated, the previously activated electronic heating layer is deactivated (i.e., turned off). In other words, a thermal wave moves through the ink from the first end 32 to the second end 34 of the page-wide array printhead assembly 30, as opposed to heating the entire volume of ink in the page-wide array printhead assembly 30.

The page-wide array printhead assembly 30 is disposed adjacent the laser system 20. The laser system 20 is operatively scanned or stepped across the page-wide array printhead assembly 30 and transmits laser energy 58 to the photon absorption layer of the heating layers 38A . . . 38H of selected nozzle systems 40 in accordance with the print information. As discussed above, the photon absorption layer absorbs the laser energy and converts the laser energy into heat, which is used to heat the ink in the ink chamber 46.

The print control system 16 controls the laser system 20 and synchronizes the scan of the laser system 16 with the sequential activation of the electronic heating layers of the heating layers 38A . . . 38H across the page-wide array printhead assembly 30 in accordance with the printing information. The synchronization includes timing the scan of the laser system 20 to follow the activation of the electronic heating layers across the page-wide array printhead assembly 30. The print information indicates which nozzle systems 40 (i.e., selected nozzle systems) to pulse with the laser system 20 as it scans the page-wide array printhead assembly 30. The print information includes information describing print indicia that are to be formed on the media. The print indicia include, but are not limited to, characters, graphics, and photographs. The page-wide array printhead assembly forms the print indicia in a sequential manner as the media moves relative to the page-wide array printhead assembly 30 and as the laser system 20 scans the page-wide array printhead assembly 30.

It should be noted, that in other embodiments, a page wide array 18 may move with respect to the media. In such embodiments, either or both the page wide array 18 and the media may move with respect to each other.

Figure 3:
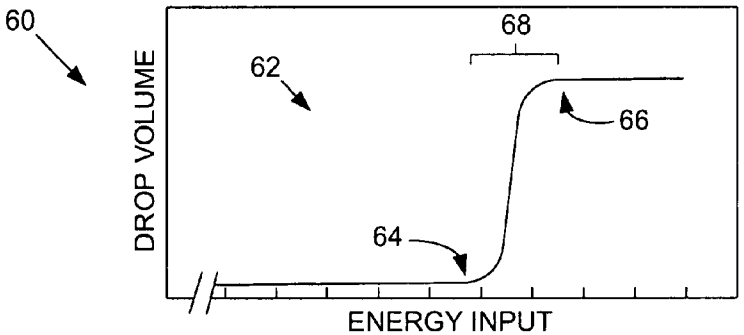
FIG. 3 is a graph illustrating an embodiment of an energy curve for ejecting a fluid drop from a thermal inkjet.

The graph in FIG. 3 illustrates a representative energy curve 62 for ejecting ink from a thermal inkjet device. The graph plots energy input (heating) into a volume of ink in a thermal inkjet device as a function of drop volume ejected. The energy curve 62 shows a lower knee 64 (lower threshold) and an upper knee 66 (upper threshold). The lower knee 64 is the area of the energy curve just before the energy curve 62 curves up, while the upper knee 66 is the area of the energy curve where it flattens out. Movement along the energy curve from the lower knee to the upper knee indicates that the energy inputted into the ink volume causes a volume of ink to be ejected from the thermal inkjet device. The ratio 68 of the lower knee 64 and the upper knee 66 is about 1 to 1.2. The advantage of heating to about the lower knee, is that a small amount of energy can then be utilized to heat the ink or fluid to the upper knee. This reduction in energy allows for heating to occur faster and with less energy than with traditional ink ejection systems that utilize optical or laser energy to heat ink or fluid for ejection.

The information from the energy curve can be used in the design of the page-wide array print system 10. In general, the ink in the ink chamber 46 can be heated to a lower knee threshold by the electronic heating layers of the heating layers 38A . . . 38H of the nozzle systems 40. The lower knee threshold represents a position on the energy curve near the lower knee 64. The lower knee threshold can be defined, for example, as sufficient energy to be about 50% to 99%, about 70% to 99%, about 80% to 99%, about 90% to 99%, or about 90% of the inputted energy to reach the lower knee.

Then, the laser system 20 emits laser energy 58 at the photon absorbing layer of selected nozzle systems 40, which absorbs the laser energy 58. The laser energy 58 from the laser system 20 is sufficient to heat the ink to an upper knee threshold. A known volume of ink is ejected from the orifice 42 of selected nozzle system 40 when the energy inputted into the ink reaches the upper knee threshold. The upper knee threshold represents a position on the energy curve near the lower knee 64. The upper knee threshold can be defined as about 101% to 150%, about 101% to 130%, about 101% to 125%, or about 120% of the upper knee.

In other words, the electrical heating layers of the heating layers 38A . . . 38H heat the ink to a first level on the energy curve and the laser system 20 heats the ink from the first level to a second level on the energy curve. Using a two-part heating process with heating layers 38A . . . 38H and the laser system 20 results in the laser system 20 having to input less total energy to eject the ink drop than if the laser system 20 is used without the assistance of the electric heating layer. This is in contrast to other laser driven systems that use the laser system to provide all of the energy to eject the ink drop.

As indicated above, the print control system 16 synchronizes the scan of the laser system 20 across the page-wide array printhead assembly 30 with sequential activation of the electrical heating layers of the heating layers 38A . . . 38H across the page-wide array printhead assembly 30. For example, the electrical heating layer in heating layer 38A of area 36A is activated by the print control system 16 to heat the ink in each nozzle system 40 in area 36A to the lower knee threshold. Once the ink in each nozzle system 40 is heated to the lower knee threshold, the print control system 16 instructs the laser system 20 to emit laser energy at selected nozzle systems 20 as the laser system 20 scans across area 36A. The photon absorbing layers of the selected nozzle systems 20 absorb the laser energy and the energy is transferred into the ink, which inputs sufficient energy to reach the upper knee threshold. As a result of the ink having sufficient energy to reach the upper knee threshold, a known volume of ink is ejected from the selected nozzle system 20. The same process occurs for each of the selected nozzle systems 20 in area 36A as the laser system 20 scans across area 36A. Once the laser system scan completes emitting laser energy at the selected nozzle systems 20 in area 36A, the electrical heating layer in heating layer 38A is deactivated and the ink in the nozzle systems 40 of area 36A is allowed to cool.

Next, the print control system 16 activates the electrical heating layer in heating layer 38B of area 36B to heat the ink in each of the nozzle systems 40 in area 36B. The electrical heating layer is activated once the laser system scan of area 36A is nearly complete. It should be noted that the electrical heating layer in heating layer 38A heats a portion of area 36B. Once the ink in each nozzle system 40 of area 36B is heated to the lower knee threshold, the print control system 16 instructs the laser system 20 to transmit laser energy at selected nozzle systems 40 in area 36B as the laser system 20 scans across area 36B. The photon absorbing layers of the selected nozzle systems 40 absorb the laser energy and the energy is transferred into the ink, which inputs sufficient energy to reach the upper knee threshold. As a result of the ink having sufficient energy to reach the upper knee threshold, a known volume of ink is ejected from the selected nozzle systems 20. The same process occurs for each of the selected nozzle systems 40 in area 36B. Once the laser system scan completes emitting laser energy at the selected nozzle systems 40, the electrical heating layer in heating layer 38B is deactivated and the ink in the nozzle systems 40 of area 36B is allowed to cool.

The same process occurs for each area 36C . . . 36H so that the ink in the selected nozzle systems 40 is heated to the lower knee threshold by the electrical heating layer in heating layers 36C . . . 36H. Subsequently, the ink in the selected nozzle systems 40 is heated from the lower knee threshold to the upper knee threshold, so that a volume of ink is ejected from the selected nozzle systems 40. The print control system repeats this process until the printing information is converted into print indicia on the printing material.

The areas 36A . . . 36H are individually activated so that the ink in the nozzle systems 40 in each area 36A . . . 36H is not at an elevated temperature for a significant length of time. This reduces the likelihood of spitting or drooling of the ink in the page-wide array printhead assembly 30. In addition, each area 36A . . . 36H is heated to the lower knee threshold to limit the amount of energy used by the laser system 20 to raise the ink to the upper knee threshold, which is more energy efficient than currently used techniques.

Figure 4:
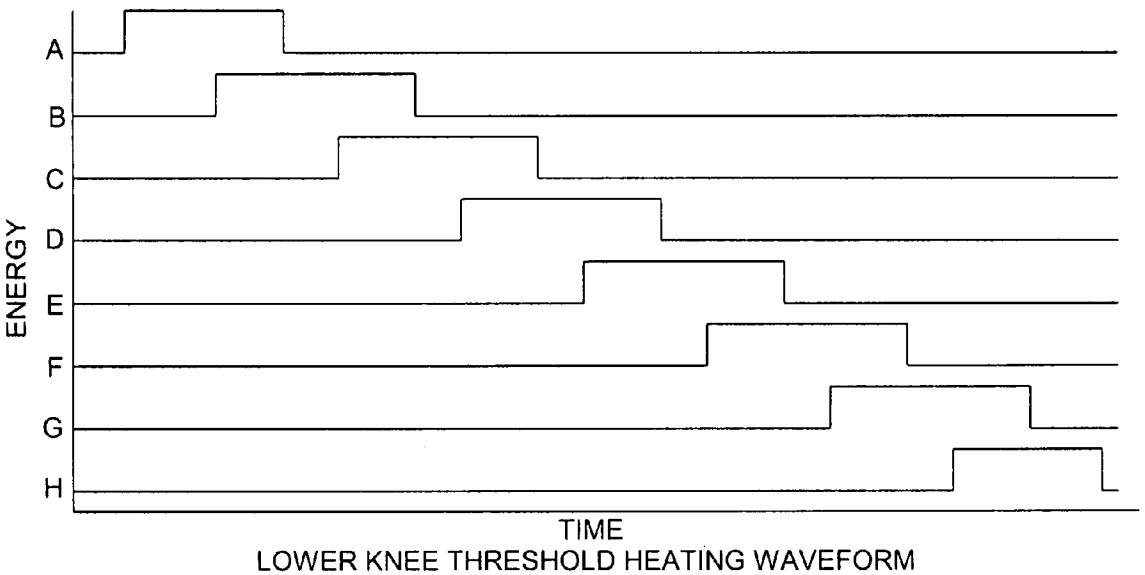
FIG. 4 includes a graph illustrating embodiments of representative heating waveforms.

FIG. 4 is a graph of representative waveforms A . . . H for activating the electrical heating layers in heating layers 38A . . . 38H, respectively. Waveforms A . . . H indicate when the electrical heating layers in heating layers 38A . . . 38H are activated and then deactivated. Activation of the electrical heating layers in heating layers 38A . . . 38H according to the waveforms A . . . H causes a thermal wave to proceed from the first end 32 to the second end 34 of the page-wide array printhead assembly 30. The activation of the electrical heating layers in heating layers 38A . . . 38H precedes the scan of the laser system 20 to allow the ink in the nozzle systems 40 in each area to be heated to the lower knee threshold.

Thus, activating the electrical heating layers in heating layers 38A . . . 38H immediately prior to scanning laser system 20 across the page-wide array printhead assembly 30 enables the page-wide array print system 10 to eject ink drops in a controlled energy efficient manner.

Figure 5:
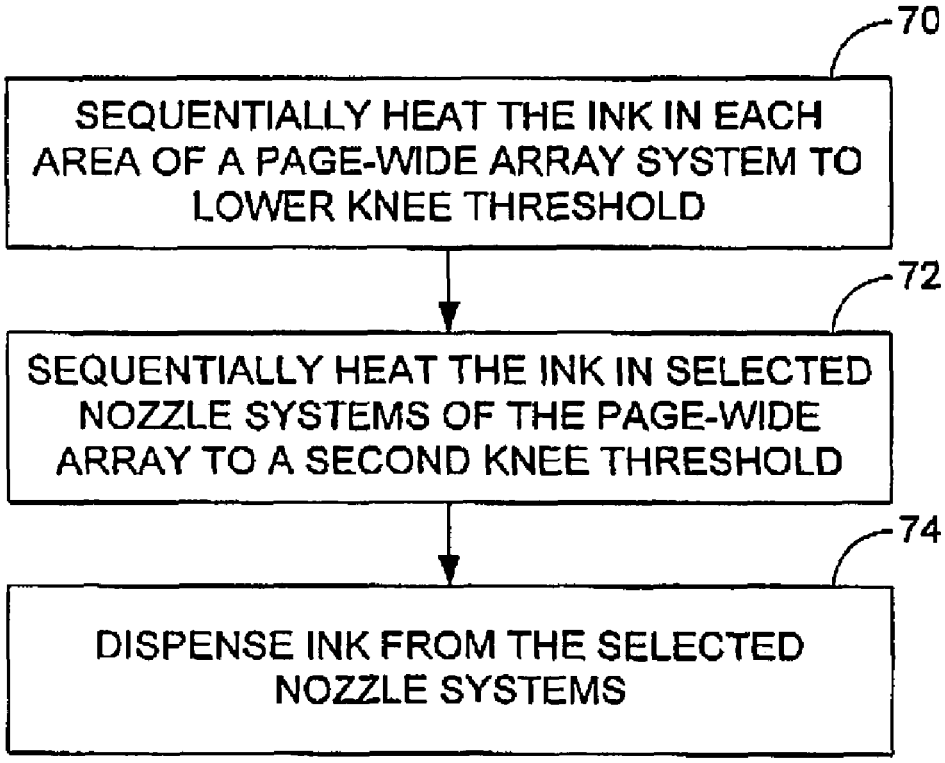
FIG. 5 is a flow diagram of a method for dispensing ink.

FIG. 5 is a flow diagram of a method for dispensing ink including the actions of sequentially heating the ink in each area of a page-wide array system to lower knee threshold (block 70), sequentially heating the ink in selected nozzle systems of the page-wide array to a second knee threshold (block 72), and dispensing ink from the selected nozzle systems (block 74).

At least the following is claimed:

1. An inkjet printhead assembly comprising:

a nozzle system including:

an ink chamber configured to receive liquid ink at ambient temperature, the ink being in a liquid state at the ambient temperature such that the ink need not be heated to enter the liquid state, an orifice layer comprising at least one orifice from which ink contained in the ink chamber can be ejected, and a heating layer comprising an electronic heating element configured to heat the liquid ink in the ink chamber from the ambient temperature to a first threshold temperature that is higher than the ambient temperature and a photon absorption layer configured to convert incident photon energy into heat; and a laser system configured to selectively emit laser energy at the photon absorption layer of the nozzle system to heat the liquid ink in the ink chamber from the first threshold temperature to a second threshold temperature that is higher than the first threshold temperature and to cause a volume of the liquid ink contained in the ink chamber to be ejected from the at least one orifice of the orifice layer.

2. The inkjet printhead assembly of claim 1, wherein the printhead assembly is a page-wide array printhead assembly that spans a width of an entire page of print media.

3. The inkjet printhead assembly of claim 1, wherein the printhead assembly is divided into a plurality of discrete areas arranged in a linear array along a length of the printhead assembly from one of its ends to the other, each discrete area comprising a plurality of the nozzle systems.

4. The inkjet printhead assembly of claim 3, wherein the printhead assembly comprises a plurality of electronic heating elements, each electronic heating element being positioned so as to overlap a portion of at least two of the discrete areas such that the electronic heating elements can simultaneously heat the portions of the at least two discrete areas when the electronic heating elements are activated to allow portions of the discrete areas and the liquid ink they contain to be separately heated instead heating an entire volume of liquid ink.

5. The inkjet printhead assembly of claim 1, wherein the electronic heating element comprises a heating resistor.

6. The inkjet printhead assembly of claim 1, wherein the electronic heating element is separated from the photon absorption layer by an electrically insulating layer.

7. The inkjet printhead assembly of claim 1, wherein the electronic heating element is substantially coplanar with the photon absorption layer but located at different positions along a length of the printhead assembly.

8. The inkjet printhead assembly of claim 1, further comprising a transparent substrate on which the heating layer is provided.

9. An inkjet printer comprising:

a printhead assembly including:

a plurality of nozzle systems arranged in a linear array along a length of the printhead assembly, each nozzle system including:

an ink chamber configured to receive liquid ink at ambient temperature, the ink being in a liquid state at the ambient temperature such that the ink need not be heated to enter the liquid state, an orifice layer comprising orifices from which ink contained in the ink chamber can be ejected, and a heating layer comprising an electronic heating element configured to heat the liquid ink in the ink chamber from the ambient temperature to a first threshold temperature that is higher than the ambient temperature and a photon absorption layer configured to convert incident photon energy into heat, and a laser system configured to selectively emit laser energy at the photon absorption layers of the nozzle systems to heat the liquid ink in the ink chambers from the first threshold temperature to a second threshold temperature that is higher than the first threshold temperature to cause volumes of the liquid ink contained in the ink chambers to be ejected from the orifices of the orifice layers; and a print control system configured to sequentially activate the electronic heating elements of the nozzle systems across the length of the printhead assembly and to separately scan the laser system across the printhead assembly in synchrony with the sequential activation of the electronic heating elements so as to generate a continuous thermal wave that traverses the length of the printhead assembly.

10. The inkjet printer of claim 9, wherein the printhead assembly is a page-wide array printhead assembly that spans a width of an entire page of print media.

11. The inkjet printer of claim 9, wherein the printhead assembly comprises a plurality of discrete areas arranged in a linear array along the length of the printhead assembly from one of its ends to the other, each discrete area comprising a plurality of the nozzle systems.

12. The inkjet printer of claim 11, wherein each electronic heating element is positioned so as to overlap a portion of at least two of the discrete areas such that the electronic heating elements can simultaneously heat the portions of the at least two discrete areas when the electronic heating elements are activated to allow portions of the discrete areas and the liquid ink they contain to be separately heated instead heating an entire volume of liquid ink.

13. The inkjet printer of claim 9, wherein the electronic heating elements comprise heating resistors.

14. The inkjet printer of claim 9, wherein the electronic heating elements are separated from the photon absorption layers by electrically insulating layers.

15. The inkjet printer of claim 9, wherein the electronic heating elements are substantially coplanar with the photon absorption layers but located at different positions along the length of the printhead assembly.

16. The inkjet printer of claim 9, further comprising a transparent substrate on which the heating layers are provided.

* * * * *